US007636028B2

(12) United States Patent
Rodseth et al.

(10) Patent No.: US 7,636,028 B2
(45) Date of Patent: Dec. 22, 2009

(54) DIAGNOSTIC FUSE INDICATOR INCLUDING VISUAL STATUS IDENTIFIER

(75) Inventors: William G. Rodseth, Antioch, IL (US); Stephen J. Whitney, Lake Zurich, IL (US)

(73) Assignee: Littelfuse, Inc., Chicago, IL (US)

( * ) Notice: Subject to any disclaimer, the term of this patent is extended or adjusted under 35 U.S.C. 154(b) by 173 days.

(21) Appl. No.: 11/458,922

(22) Filed: Jul. 20, 2006

(65) Prior Publication Data

US 2007/0018775 A1 Jan. 25, 2007

Related U.S. Application Data

(60) Provisional application No. 60/701,228, filed on Jul. 20, 2005.

(51) Int. Cl.
*H01H 85/30* (2006.01)

(52) U.S. Cl. ..... 337/243; 337/206; 337/241; 337/265; 324/550

(58) Field of Classification Search ..... 337/206, 337/297, 241, 243, 265; 324/550
See application file for complete search history.

(56) References Cited

U.S. PATENT DOCUMENTS

| | | | | | |
|---|---|---|---|---|---|
| 737,280 | A | * | 8/1903 | Sachs | 337/243 |
| 809,978 | A | | 1/1906 | Ogle | |
| 821,873 | A | | 5/1906 | Hoffmann | |
| 866,716 | A | | 9/1907 | Cole | |
| 1,014,741 | A | | 1/1912 | Barringer et al. | |
| 1,040,150 | A | | 10/1912 | Cole | |
| 1,087,120 | A | | 2/1914 | Hooker | |
| 1,591,029 | A | | 7/1926 | Feldkamp | |
| 2,164,658 | A | * | 7/1939 | Lyon | 337/242 |
| 2,206,784 | A | | 7/1940 | Linton | |
| 2,794,095 | A | | 5/1957 | Kozacka | |
| 2,809,254 | A | | 10/1957 | Edsall | |
| 3,047,695 | A | | 7/1962 | Borys | |
| 3,116,390 | A | | 12/1963 | Goody et al. | |
| 3,253,104 | A | | 5/1966 | Fister | |
| 3,453,580 | A | | 7/1969 | Withers | |
| 3,513,427 | A | | 5/1970 | Browne et al. | |
| 3,585,555 | A | | 6/1971 | Yamada | |
| 3,678,430 | A | | 7/1972 | Gaia | |
| 3,721,936 | A | * | 3/1973 | Belcher | 337/241 |
| 3,729,656 | A | | 4/1973 | Luquain | |
| 4,035,754 | A | | 7/1977 | Kleinbohl | |
| 4,058,784 | A | | 11/1977 | Gaia | |
| 4,142,151 | A | | 2/1979 | Hansen | |
| 4,156,225 | A | | 5/1979 | Cuzzone | |
| 4,308,515 | A | | 12/1981 | Rooney et al. | |
| 4,308,516 | A | | 12/1981 | Shimada et al. | |
| 4,404,536 | A | * | 9/1983 | Still | 337/201 |
| 4,484,185 | A | | 11/1984 | Graves | |
| 4,527,143 | A | | 7/1985 | Thienel | |
| 4,641,120 | A | | 2/1987 | Bonfig et al. | |
| 4,760,367 | A | * | 7/1988 | Williams | 337/241 |
| 4,782,317 | A | | 11/1988 | Thwaites | |

(Continued)

*Primary Examiner*—Anatoly Vortman
(74) *Attorney, Agent, or Firm*—Duane Morris LLP

(57) ABSTRACT

Electrical fuse indicators which may be used to diagnose and identify a fault state or failure mode of the electrical fuse include in various exemplary embodiments, indicator materials such as a reactive material, which are incorporated into various fuse indicator devices to cooperate with a visually perceptible indicator portion or layer to indicate the failure mode or fault state if the electrical fuse.

20 Claims, 8 Drawing Sheets

U.S. PATENT DOCUMENTS 5,001,451 A 3/1991 Morrill et al.
5,032,946 A 7/1991 Misencik et al.
5,111,177 A 5/1992 Krueger et al.
5,113,169 A 5/1992 Ruehl et al.
5,343,185 A * 8/1994 Mosesian et al. ..... 337/163
5,345,210 A 9/1994 Swensen et al.
5,673,028 A 9/1997 Levy
5,712,610 A * 1/1998 Takeichi et al. ..... 337/290
5,781,095 A * 7/1998 Dietsch et al. ..... 337/243
5,821,849 A 10/1998 Dietsch et al.
5,841,337 A 11/1998 Douglass
5,936,508 A 8/1999 Parker
5,994,993 A * 11/1999 Castonguay et al. ..... 337/206
6,456,189 B1 9/2002 Mosesian et al.
6,859,131 B2 * 2/2005 Stanek et al. ..... 337/206
2002/0175800 A1 * 11/2002 Stanek et al. ..... 337/206
2006/0068179 A1 * 3/2006 Weihs et al. ..... 428/209

* cited by examiner

DIAGNOSTIC FUSE INDICATOR INCLUDING VISUAL STATUS IDENTIFIER

PRIORITY CLAIM

This application claims priority to and the benefit of U.S. Provisional Patent Application No. 60/701,228, filed Jul. 20, 2005, entitled "Diagnostic Fuse Indicator Including Visual Status Identifier," the entire contents of which are hereby incorporated by reference and relied upon.

BACKGROUND

Electrical fuses for protecting electrical circuits are well-known in the art. Such fuses may protect large or small voltage applications. Fuses that are used to protect electrical circuits associated with motors and other large voltage electrical applications are commonly known in the art as "power fuses."

Power fuses often include complicated indicator mechanisms to identify the state or status of the fuse. For example, U.S. Pat. No. 6,859,131 owned by Littelfuse, Inc., the assignee of the present patent, discloses a fuse indicator that provides a perceivable distinction between a fuse opened due to a current overload and a fuse opened due to a short circuit. The known fuse indicator includes a fuse having both a short circuit element and a current overload element coupled to, for example, an igniter wire and white gun cotton. The white gun cotton provides a state indicator before and after combusting with the igniter wire in response to electrical energy received by the short circuit or current overload element.

Furthermore, many known fuse indicators, while effective at identifying the fault state of the fuse, are often relatively complicated and/or difficult to manufacture. Thus, a need exists for a simple and efficient diagnostic fuse indicator which can be adapted for use with one or more fuse elements to identify the state or status of the fuse and a mode of failure for same.

SUMMARY

Illustrative examples of diagnostic fuses and fuse indicators are discussed below in the Detailed Description section of the specification. The examples include various embodiments and configurations of fuse indicators that incorporate a reactive material and/or indicator material arranged to cooperate with short circuit elements and overload elements.

In particular, one example includes a diagnostic fuse indication device having a short circuit element. The short circuit element includes a short circuit indicator electrically coupled to the short circuit element in a parallel arrangement and an overload current element electrically coupled to the short circuit element in a series arrangement and electrically coupled to the short circuit indicator in a series arrangement. The diagnostic fuse indication device further includes an overload current indicator electrically coupled to the overload current element in a parallel arrangement, and electrically coupled to the short circuit element in a series arrangement. The overload current indicator, in turn, includes a first indicator material deposited adjacent to the short circuit indicator and a second indicator material deposited adjacent to the overload current indicator such that the first indicator material reacts in response to a short circuit event to reveal the short circuit indicator, and the second indictor material reacts in response to an overload current event to reveal the overload current indicator.

In other examples, the short circuit element is a conductive metal comprising a plurality of bridges. The overload current element can be manufactured from the material selected from the group consisting of copper-nickel alloy, silver plated brass, tin-lead solder, lead free solder, copper, gold, silver, zinc or their alloys having a suitably low melting temperature.

In another example the first and second indicator materials are reactive materials such as a nano-layered film. The reactive material is configured to produce a self-propagating exothermic reaction in response to an energy input. The energy input can be selected from the group consisting of a current overload, a short circuit, a heated filament, a flame, focused radio frequency radiation, or light amplification by stimulated emission of radiation. The reactive material can further be deposited to form at least one high resistance bridge.

In another example the diagnostic fuse indicator can include a first offset resistor electrically coupled to the short circuit indicator in a series arrangement, and a second offset resistor electrically coupled to the overload current indicator in a series arrangement. In other examples, the reactive material is deposited to form at least one spark gap.

In another example, a diagnostic fuse indication device includes a short circuit element coupled to a short circuit indicator, an overload current element electrically coupled to the short circuit element in a series arrangement and an overload current indicator electrically coupled to the overload current element in a parallel arrangement. The diagnostic fuse indication device further includes a first reactive material deposited adjacent to the short circuit indicator and a second reactive material deposited adjacent to the overload current indicator. The first reactive material reacts in response to a short circuit event to reveal the short circuit indicator and the second reactive material reacts in response to an overload current event to reveal the overload current indicator.

In another example, the reactive material is configured to produce a self-propagating exothermic reaction. The reactive material can be a nano-layered film or an indicator material consisting of high-carbon content silver.

In another example, the diagnostic fuse indication device includes an insulating substrate manufactured from the material selected from the group consisting of flame retardant woven glass reinforced epoxy laminates, non-woven glass laminates, ceramics, glass, polytetrafluoroethylene, microfiber glass substrates, thermoset plastics, polyimide materials or any combination of these materials or any other suitable materials.

Additional features and advantages of the present invention are described in, and will be apparent from, the following Detailed Description and the figures.

DETAILED DESCRIPTION

This patent generally relates to electrical fuses, and more specifically to electrical fuse indicators which may be used to diagnose and identify a fault state or failure mode of the electrical fuse. Referring to the figures and the detailed description, numerous exemplary embodiments of a diagnostic fuse indicator constructed in accordance with the disclosure presented herein are described to provide the reader with an understanding of some of the capabilities and advantages realized by the invention.

Figure 1A:
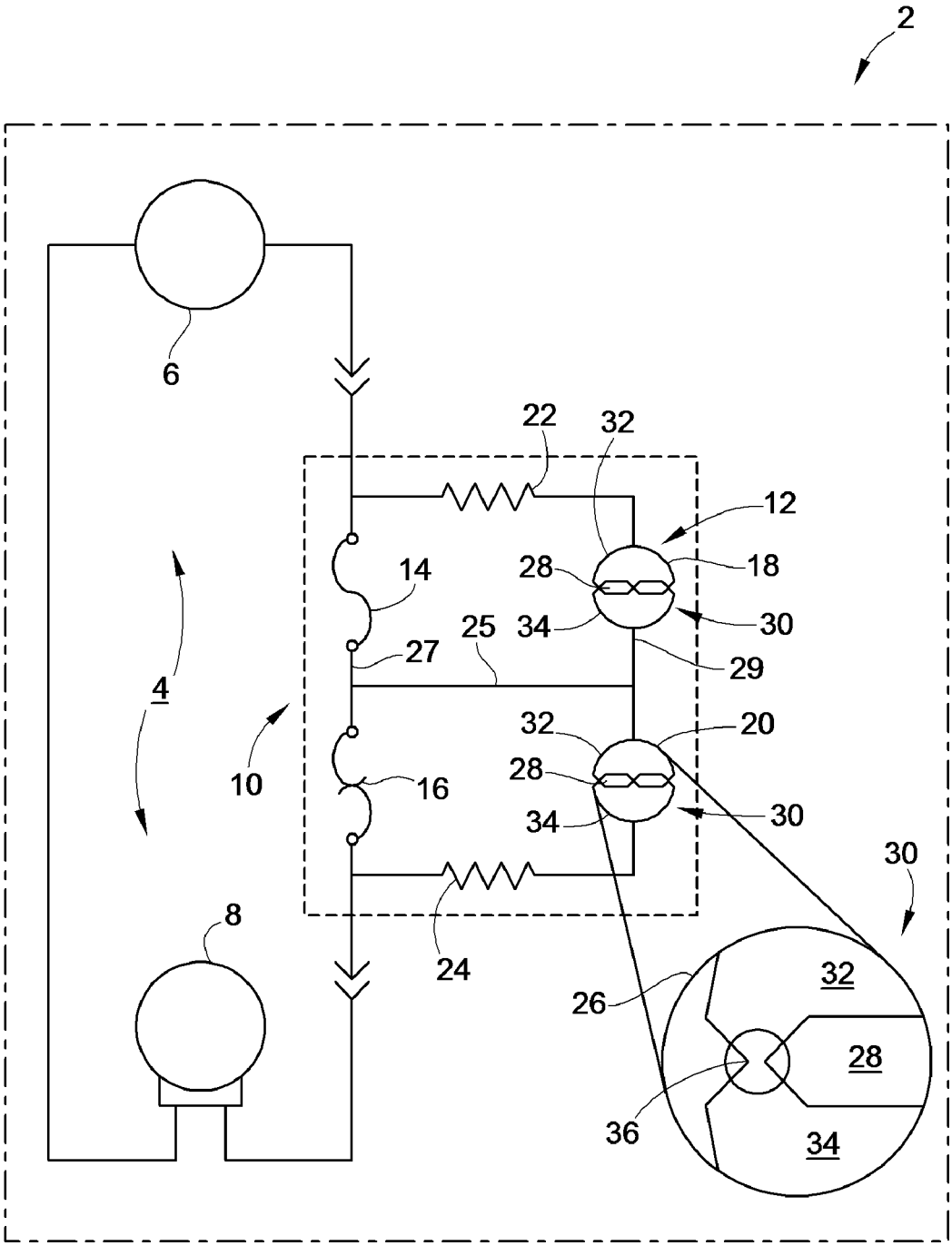
FIGS. 1A and 1B are schematic views of two embodiments of dual fuse indicators including visual status identifiers constructed in accordance with the disclosure provided herein.

Referring now to the drawings, FIG. 1A illustrates a schematic view of one embodiment of an electrical fuse 2 operably coupled within a circuit 4. Circuit 4 includes an electrical power source 6 arranged to drive a load 8. In particular, the power source 6 is electrically coupled to the load 8 which may be, for example, a motor, a sensor, etc. The electrical fuse 2 is arranged within the circuit 4 to protect the load 8 and the wiring comprising circuit 4 against a fault condition such as a short circuit or an overload current.

The electrical fuse 2 further includes or is electrically coupled to a fuse element assembly 10 and a fuse indicator assembly 12. In this example, the fuse element assembly 10 is a dual element type having (a) a short circuit element 14 electrically coupled to (b) an overload current element 16 in a series arrangement. It will be appreciated that any suitable type of single element indicator may also be constructed according to the teachings herein. For example, a short circuit product with no overload section may be constructed, or an overload product with no short circuit section may be constructed. In addition, a dual element fuse with a single indicator section across both elements in series may be constructed to indicate a failure without necessarily indicating the type of failure.

In the exemplary embodiment illustrated in FIG. 1A, the short circuit element 14 is made from a conductive metal or conductive alloy such as, for example, a copper-nickel alloy, silver plated brass, tin-lead solder, lead-free solder, copper, gold, silver, zinc, alloys of these material and other metal having a suitably low melting temperature. The short circuit element 14 typically acts as a high resistance bridge and opens by self-heating and melting in response to a short circuit within the circuit 4.

Similarly, the overload current element 16 or time delay element, in one exemplary embodiment is manufactured from a tin-lead (SnPb) solder compound. The solder compound can include a plurality of solder bars or wires supported within an insulating housing. Heat is transferred to the solder bars in response to a current overload. Alternatively, the solder compound can be an uninsulated element or structure having sufficient mass to delay the melting or opening time of the overload current element 16 for a desired time period. For example, under normal operating conditions the current flow through the solder mass causes a temperature increase within the solder mass, but does not heat the mass to the solder melting point of approximately 500° F. (260° C.). During an overload event or situation, the increase in current flow causes the temperature of the solder mass to increase. If the overload condition is a sustained overload, the solder mass will eventually reach the melting point and open the circuit 4.

It should be appreciated that the solder bars or solder mass do not act as a high resistance bridge, which opens upon a short circuit. Likewise, the melting temperature of the preferably copper or copper alloy short circuit element 14 is significantly higher 1985° F. (1085° C.) for copper and 2228° F. (1220° C.) for 55% Cu and 45% Ni) than for the tin-lead solder. Therefore, a sustained overload event or state melts the solder overload current element 16 long before melting the copper or copper-alloy short circuit element 14.

The fuse indicator assembly 12 includes (a) short circuit indicator 18 and (b) an overload current indicator 20 electrically coupled in a series arrangement with each other, and in a parallel arrangement with short circuit element 14 and overload current element 16. In particular, the fuse element assembly 10 and the fuse indicator assembly 12 provide independent circuit paths between the source 6 and the load 8. A pair of offset resistors 22, 24 are arranged to isolate the fuse indicator assembly 12 during normal operations by presenting a higher impedance than the short circuit and overload elements 14, 16.

A shunt 25 electrically couples to fuse element conductor 27 that connects the short circuit element 14 to the overload element 16. The shunt 25 is illustrated as a single wire that bisects the short circuit element 14 from the overload element 16, and the short circuit indicator 18 from the overload current indicator 20 via a fuse element conductor 27 and an indicator conductor 29, respectively. However, the shunt 25 is adaptable to include a number of splices, include one or more terminals, or terminals in combination with one or more wires. Moreover, the shunt 25 could be separated into a pair of shunting connectors that are arranged to directly connect each of the indicators 18, 20 to the fuse element conductor 27. Indicator conductor 29 is typically a wire, terminal or other suitable conducting device for electrically coupling the short circuit indicator 18 and the current overload indicator 20. Any one or more of the conductors 25, 26, 27 and 29 can all include one or more trace on a printed circuit board ("PCB").

The fuse short circuit indicator 18 and the overload indicator 20 as shown in the enlarged view of callout 26 each include a visually perceptible indicator portion 28, at least substantially fully coated or covered with a layer of an indicator material, e.g., a reactive material 30. The indicator material 30 includes a first section 32 and a second section 34 separated by a plurality of high resistance bridges 36. Each bridge 36 is a narrowed segment between sections 32 and 34, which focuses the flow of electrical energy, i.e., electrical current, through the indicator material 30. The electrical "bottleneck" creates an area or point of high resistance.

In one example, the indicator material 30 includes a reactive material, which can be a thermal interface material such as, for example, a NanoFoil® material produced by Reactive Nano Technologies, Inc. (RNT) of Hunt Valley, Md. Reactive material 30 can be configured as a foil sheet or otherwise suitable geometry to provide a desired localized heat source. Reactive material 30, such as the NanFoil® material, can include a plurality of alternating layers or non-layers, each around a 100 nanometers (nm) thick. As described below, the nano-layers react to produce an exothermic reaction.

The alternating nano-layers of reactive material may initially be any one or more of a variety of materials, such as nickel (Ni) and aluminum (Al) that react in response to an energy source to create a NiAl reaction product. Other initial reactants and their resulting reaction products may include: titanium (Ti) and boron (B), and titanium boride ($TiB_2$); zirconium (Zr) and boron, and zirconium boride ($ZrB_2$); hafnium (Hf) and boron, and hafnium boride ($HfB_2$); Ti and carbon (C), and titanium carbide (TiC); Zr and carbon, and zirconium carbide (ZrC), Hf and carbon, and hafnium carbide (HfC); Ti and silicon (Si) and $Ti_5Si_3$; Zr and silicon, and $Zr_5Si_3$; niobium (Nb) and silicon, and $Nb_5Si_3$; Zr and Al, and ZrAl; lead (Pb) and Al, and PbAl. Application of an energy source to the nano-layers in their initial state results, in a self-propagating exothermic reaction, which causes a change in phase of the solid foil to a liquid or gaseous state.

The application of an energy source such as, for example, a spark or thermal input generated by the heat buildup of an overload current to the nano-layers of the reactive material 30 initiates a self-propagating reaction at the one or more bridge 36. In one embodiment, the energy source could be provided by a separate igniter circuit coupled to a control and monitoring device. The control device can monitor the physical characteristics of the electrical fuse 2 and the circuit 4 and generate an energy source to open the fuse elements 14, 16 and activate the indicators 18, 20. In this manner the control device can actively protect and monitor the responses and performance of the circuit 4 and the devices electrically coupled thereto. In particular, the increased energy flow applied to the bridge or bridges 36 causes an increase in heat, which initiates the self-propagating reaction. The reaction travels through the nano-layers creating a focused, localized heat source as the nano-layers exothermically convert into one or more of the above-identified reactants. Alternatively, or in addition, a high resistance foil may be used to achieve the same result with or without the external offset resistors 22, 24.

The self-propagating exothermic reaction converts the initial reactants into a gas or powdered state, thereby revealing the visually perceptible indicator layer 28 located behind or underneath the reactive material 30. By selecting the background for the visually perceptible indicator layer 28 to have a different color, pattern, etc., to represent an overload state and a short circuit event, each of the indicators 18, 20 can be used to provide a quick and easy diagnostic tool for determining the fault state or failure mode of the electrical fuse 2.

In operation, energy flows from the source 6 through the short circuit element 14 and the overload element 16 to drive the load 8. Offset resistors 22, 24 present a higher impedance than the fuse elements 14, 16 to thereby direct energy away from the short circuit indicator 18 and the overload indicator 20 under normal operation.

In the event of a short circuit occurring in circuit 4, the high resistance bridge of the short circuit element 14 melts and opens. It will be understood, that the time required to interrupt the short circuit condition is insufficient to transfer enough energy and heat to melt solder mass of the overload element 16, thereby leaving the element intact. The failure or opening of the short circuit element 14 directs energy through the offset resistor 22, to the short circuit indicator 18, and through shunt 25 back to circuit 4. The sudden energy increase provides the energy source needed to initiate the self-propagating reaction of the reactive material 30 of indicator 18. The reactive material 30, in turn, exothermically reacts to produce reaction products (discussed above) in a gaseous or finely powdered state. As a result of the consumption of the reactive material 30, the visually perceptible indicator layer 28 of indicator 18 becomes visible and shows that the failure mode or fault state resulted from an electrical short circuit. After material 30 of indicator 18 is consumed, circuit 4 is opened, no current flows and the short circuit is mitigated.

Alternatively, the occurrence of a sustained overload current will, over time, transfer sufficient energy in the form of heat to the solder mass or bars of the overload element 16 to cause the element to melt and open. The effect of the sustained increase or overload current on the high resistance bridge of the short circuit element 14 is insufficient to cause it to open. The failure or opening of the overload element 16 directs energy through the offset resistor 24, to the overload indicator 20, and through shunt 25 back to circuit 4. The sudden energy increase provides the energy source needed to initiate the self-propagating reaction of the reactive material 30 of indictor 20. The reactive material 30, in turn, reacts exothermically to produce reaction products in a gaseous or finally powdered state. As a result of the removal of the reactive material 30, the visually perceptible indicator layer 28 of indicator 20 becomes visible and shows that the failure mode or fault state resulted from a sustained current overload. After material 30 of indictor 18 is consumed, circuit 4 is opened, no circuit flows and the current overload is mitigated.

Figure 1B:
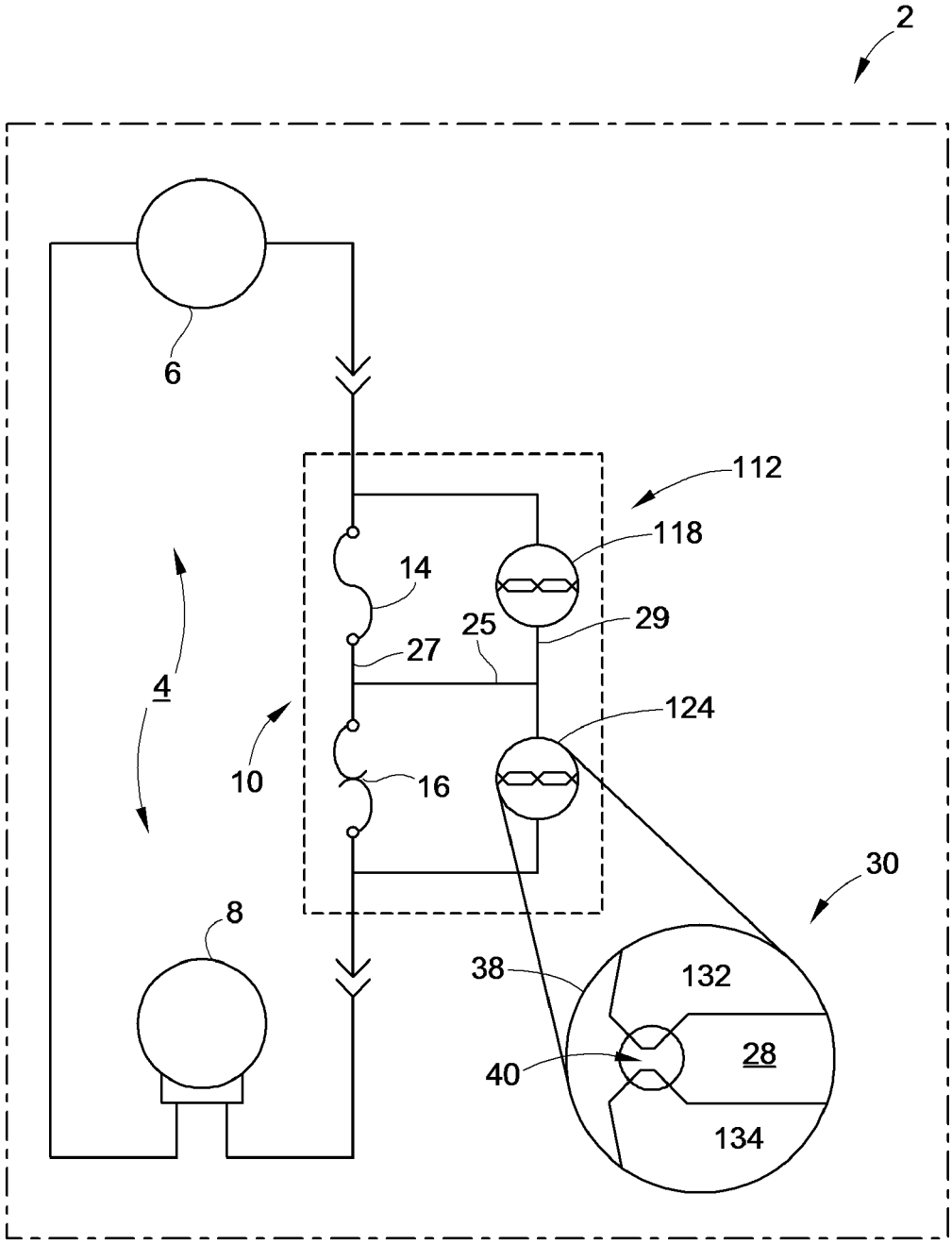

FIG. 1B illustrates a schematic view of another embodiment of the electrical fuse 2 coupled operably to the circuit 4, the electrical power source 6, and load 8. This exemplary embodiment includes an alternative fuse indicator assembly 112, which includes short circuit indicator 118 and overload current indicator 124. As before, the short circuit indicator 118 and the overload current indicator 124 of the present example remain electrically coupled in a series arrangement with each other, and in a parallel arrangement with short circuit element 14 and the overload current element 16. However, the short circuit indicator 118 and the overload indicator 124 are directly connected across the short circuit and overload elements 14, 16 without the need for additional resistors or other components that can produce introduce increased impedance into the circuit 4.

The fuse indicator 118 and the overload indicator 124 as shown in the enlarged view of callout 38 each include the visually perceptible indicator portion 28 at least substantially fully coated or covered with a layer of a reactive material 30. The reactive material 30 includes a first section 132 and a second section 134 separated by at least one spark gap 40. The at least one spark gap 40 controls and prevents the flow of electrical energy, i.e., electrical current, through the reactive material 30. In particular, during normal operation the at least one spark gap 40 provides an electrical discontinuity or opening that prevents the flow of current through the fuse indicator assembly 112. The spark gap(s) 40 serve the additional function of offset resistors 22, 24 of short circuit indicator assembly 12 shown in FIG. 1A.

When a failure mode or fault state occurs, either the short circuit or overload elements 14, 16 opens (depending on the type of fault as described above), forcing current or energy flow through conductor 27, shunt 25 and the respective short circuit indicator 118 or the overload indicator 124. The increased energy flow directed through the short circuit indicator 118 or the overload indicator 124 cause electrical current to spark, jump or otherwise flow from the first section 132 to the second section 134 of the reactive material 30.

The presence of at least one spark, or a continuous series of sparks, across the spark gap 40 provides the energy source necessary to initiate the self-propagating reaction of the reactive material 30 associated with the indicator 118 or 124. Depending on which of the fuse elements is affected by the particular fault, i.e., the short circuit element 14 or the overload element 16, the corresponding short circuit indicator 118 and/or the overload indicator 124 is consumed as described above to reveal the visually perceptible indicator portion 28 beneath material 30 of the associated indicator. The consumption of material 30 causes the spark gap 40 to widen sufficiently such that energy can no longer spark or jump across spark gap 40. At that point circuit 4 opens thereby mitigating the fault.

FIGS. 2 and 2A to 2D illustrate one exemplary physical embodiment of the fuse indicator assembly 12. In this exemplary embodiment, the fuse indicator assembly 12 includes (a) a substrate 42 having (b) a plurality of through-hole connectors C, S and O electrically coupled via (c) a plurality of electrical pathways 44, 46, 48, 50 and 52. The substrate 42 further carries (d) offset resistors 22, 24, (e) the short circuit indicator 18, (f) the overload indicator 20, and (g) a protective covering 54.

The substrate 42 is an insulating substrate material such as, for example, flame retardant woven glass, reinforced epoxy laminates, non-woven epoxy glass laminates, ceramics, glass polytetrafluoroethylene, microfiber glass substrates, thermoset plastics, polyimide materials, or any combination of these materials. The plurality of electrical pathways 44, 46, 48, 50 and 52 in a embodiment are copper and can be deposited or formed on a top surface 56 of the substrate 42 using any known manufacturing techniques such as, for example, photo-imaging, dry film processing, sputtering and electroplating.

Figure 2:
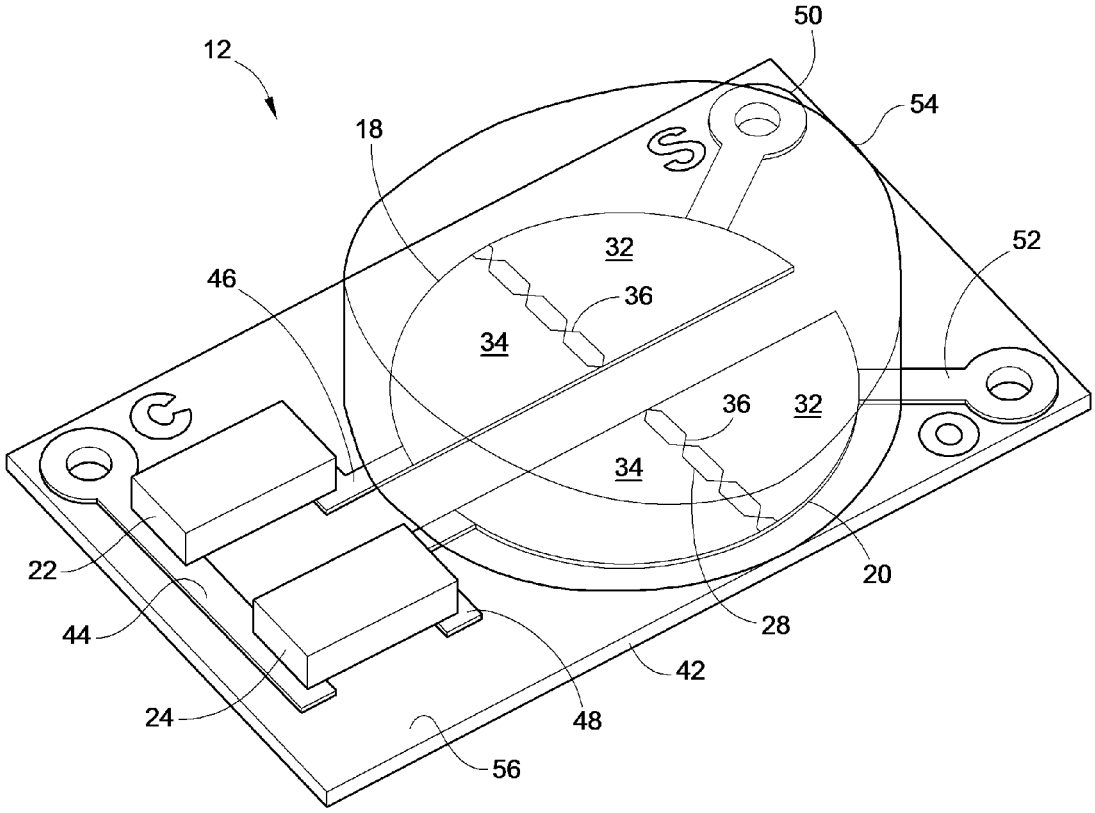
FIG. 2 is a perspective view of one embodiment of a fuse indicator device shown in FIG. 1A.

Protective covering 54 can include any suitable material, such as an epoxy resin, glass covering, etc. In the embodiment of FIG. 2 the protective covering 54 is 2 clear or otherwise see-through shield.

The through-hole connector S is coupled electrically to the short circuit element 14 while the through-hole connector O is coupled electrically to the short circuit element 16 of circuit 4 (not shown). Each of these through-hole connectors S, O, in turn, is connected to short circuit indicator 18 and overload indicator 20, respectively. The short circuit indicator 18 and the overload indicator 20 are coupled electrically to ground or common through-hole connector C via the offset resistors 22, 24. This is in contrast to the schematic representation in FIGS. 1A and 1B where the resistors 22 and 24 are connected to the short circuit and overload elements individual rather than the common connection as shown in FIG. 2.

As described previously, a short circuit causes self-heating and melting of the short circuit element 14, thereby directing the excess electrical energy through connector S and electrical pathway 50 to the short circuit indicator 18. The short circuit indicator 18, in turn, channels or focuses the electrical energy through its high resistance bridge or bridges 36 (see FIG. 2C). Excessive electrical energy overloads the bridge(s) 36 initiating the self-propagating reaction of the reactive material 30 of indicator 18. The self-propagating reaction consumes at least a portion of the first and second sections 32, 34, thereby exposing the visually perceptible indicator portion 28 located beneath material 30. The reaction of the first and second sections 32, 34 is sealed within the shield 54 such that the reactant products are contained.

Similarly, a sustained overload current causes the solder mass or solder bars of the overload element 16 (not shown) to melt, thereby directing the excess electrical energy through the electrical pathway 52 to the overload indicator 20. As with the short circuit indicator 18, the overload indicator 20 focuses the electrical energy through the high resistance bridge(s) 36, thereby initiating the self-propagating reaction of material 30. The exothermic reaction converts the reactants into their corresponding reaction products which, in turn, are sealed within the protective cover 54. The protective cover 54 as illustrated can also be a clear or see-through plastic of glass housing.

Figure 2A:
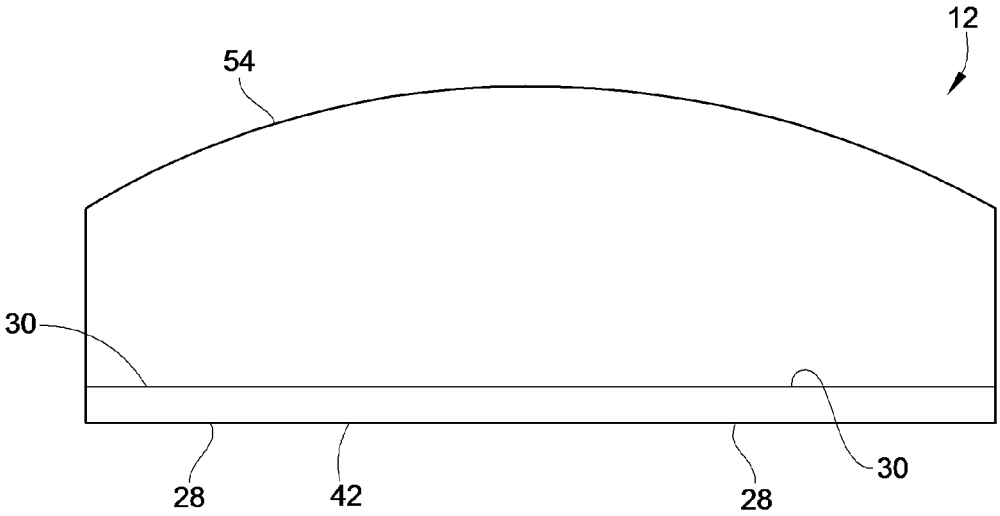
FIG. 2A is an end view of the fuse indicator device shown in FIG. 2.
Figure 2B:
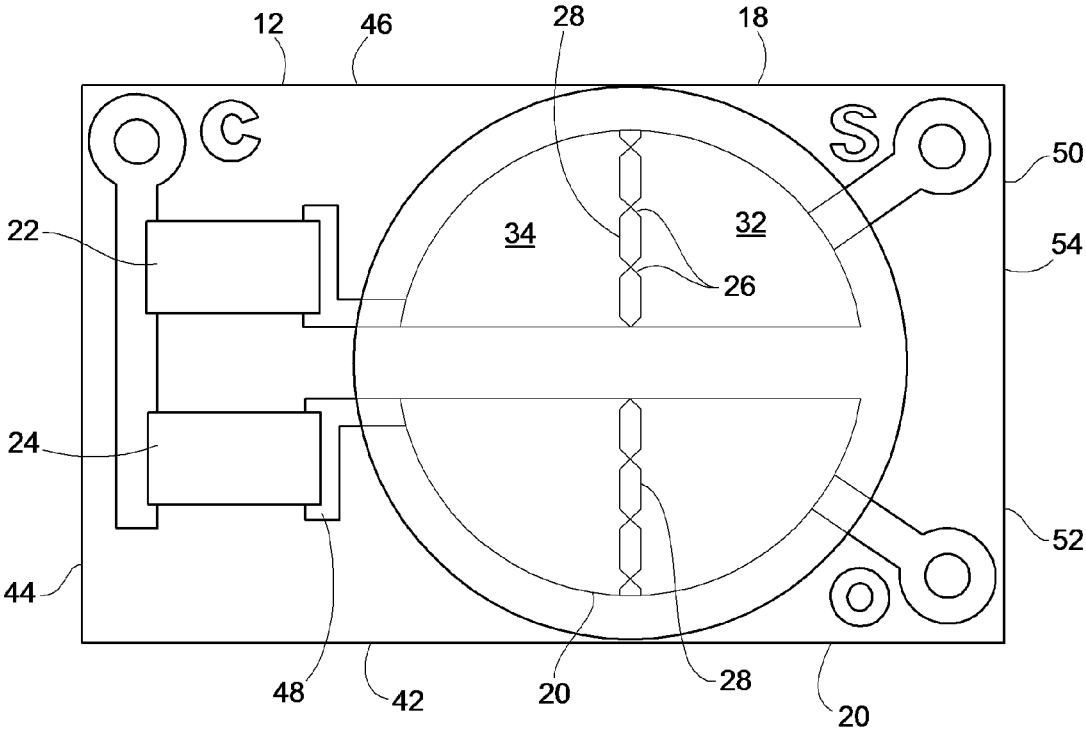
FIG. 2B is a plan view of the fuse indicator device shown in FIG. 2.
Figure 2C:
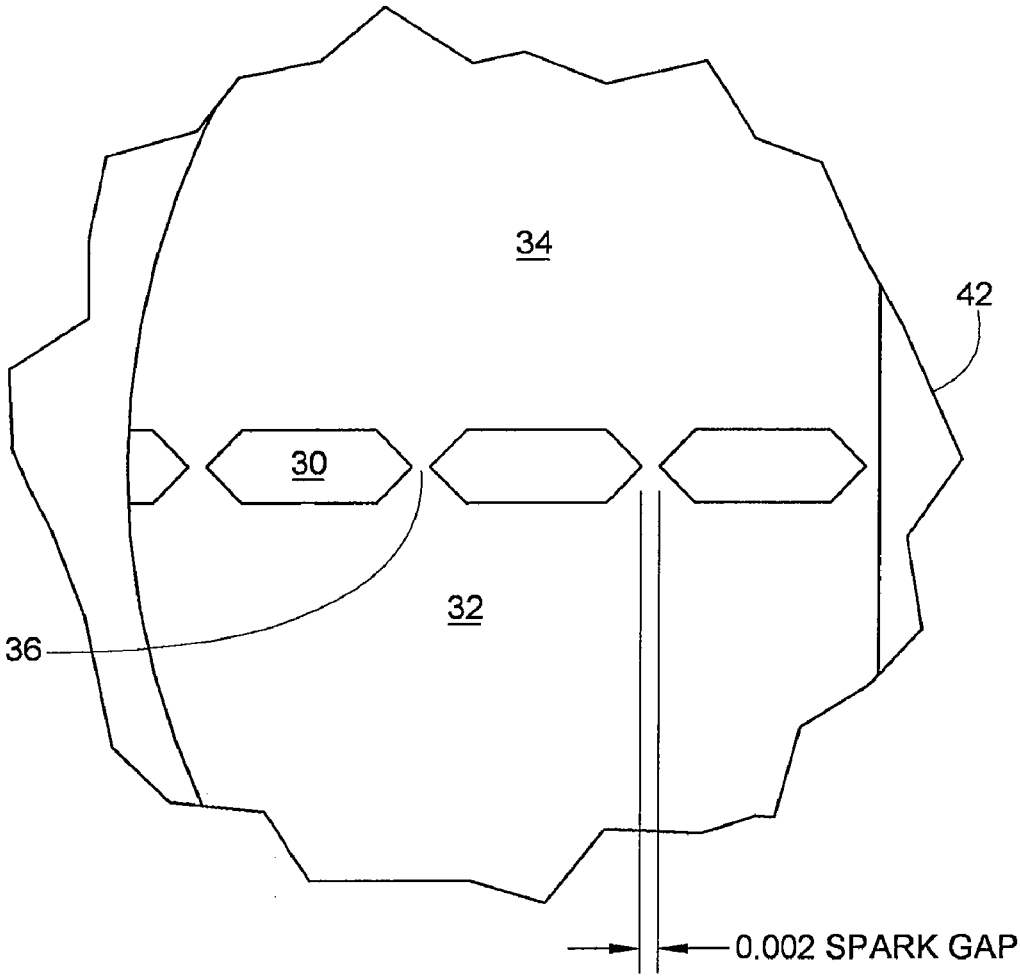
FIG. 2C is an enlarged plan view of an indicator element shown in Detail A of FIG. 2B.

FIG. 2A illustrates a side elevation view of the substrate 42 carrying the shield or protective cover 54. The layers of the reactive material 30 overlying the visually perceptible indicator portions 28 are shown with an exaggerated thickness to clearly indicate their relative positions under the protective cover 54. FIG. 2B illustrates a plan view of the substrate 12 carrying the various components and elements of the exemplary fuse indicator 12 shown in FIG. 2. FIG. 2C illustrates overload indicator 20 before the onset of an overload current failure mode. FIG. 2C is an enlarged view of Detail A shown in FIG. 2B that clearly shows the reactive material 30 and a plurality of high resistance bridges 36 in an intact state, i.e., the reactive or indicator material is not yet reacted to form reaction products, illustrating a 0.002 inch (50 micrometer) resistance bridge or spark gap in portions of the reactive material. Accordingly, the visually perceptible indicator portion 28 is largely hidden.

Figure 2D:
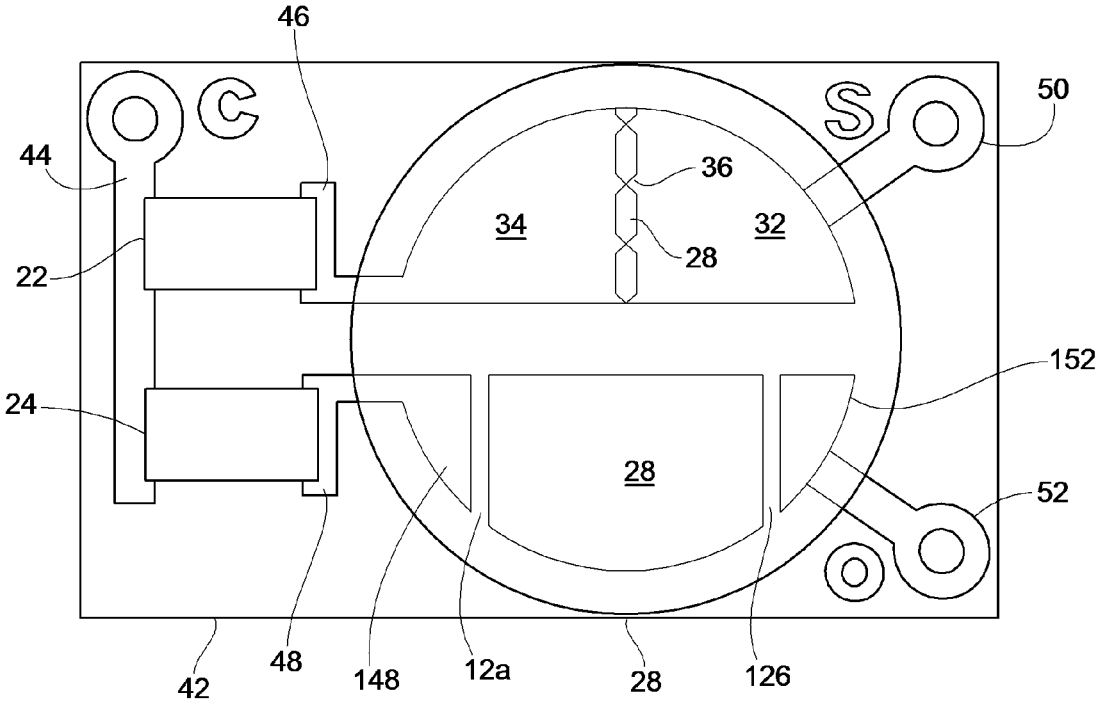
FIG. 2D is a top view of the fuse indicator device shown in FIG. 2 identifying the fault status of a fuse.

FIG. 2D illustrates the overload indicator 20 after the onset of the overload current failure mode, wherein the visually perceptible indicator portion 28 is exposed to identify the fault state. Here, material 30 has consumed itself, vaporizing and exposing portion 28. The cover 54 contains and controls the reaction products created during the self-propagating reaction of the reactive material 30. The electrical pathways 48, 52 include contact pads 148 and 152 deposited adjacent to voids or spacers 12*a* and 12*b*. The voids 12*a*, 12*b* isolate, highlight and distinguish the visually perceptible indicator portion 28.

It should be appreciated that the teachings from FIGS. 2 to 2D are equally applicable to the spark gap fuse assembly 112, which negates the need for the offset resistors 22 and 24 in FIGS. 2, 2B and 2D.

Figure 3:
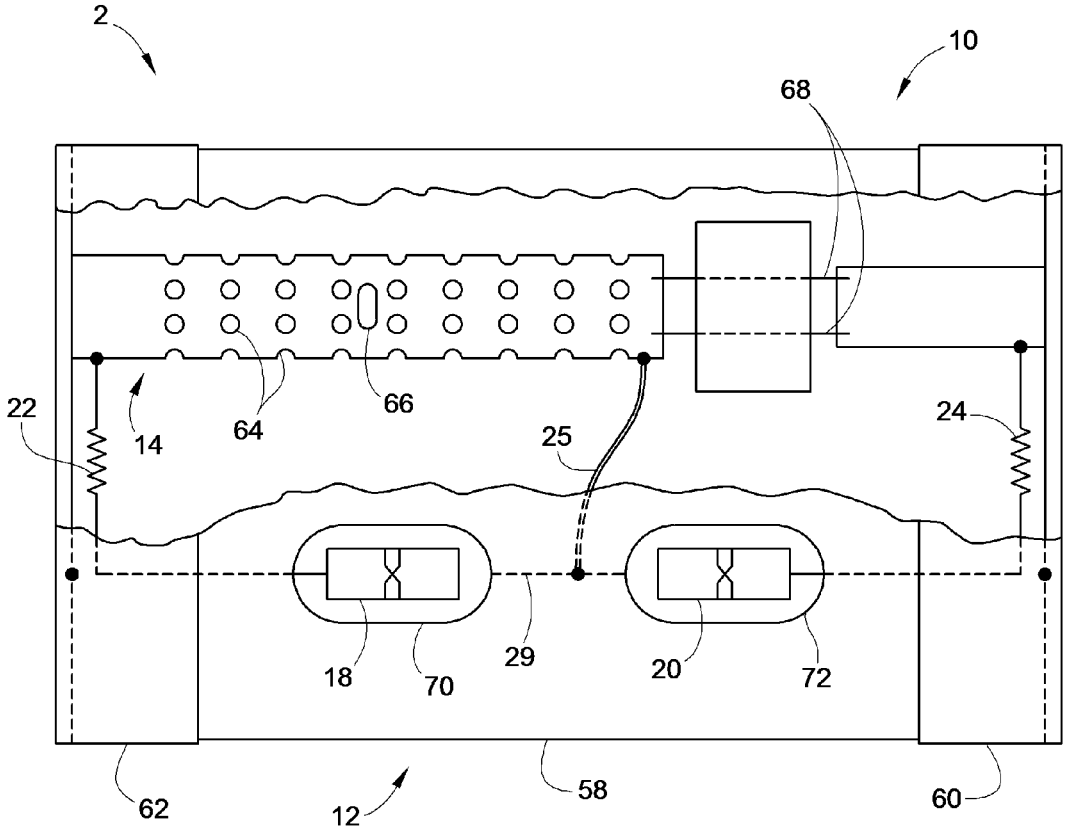
FIG. 3 is a side elevation view of an electrical fuse incorporating the embodiment of the fuse indicator shown in FIG. 1A.

FIG. 3 illustrates another exemplary embodiment of the electrical fuse 2 incorporating the fuse element assembly 10 and the fuse indicator assembly 12. The electrical fuse 2 includes (a) an insulating body or housing 58 having (b) a first conductive cap 60 and (c) a second conductive cap 62 secured to opposing ends of the housing 58. The fuse element assembly 10 includes the short circuit element 14 formed from a strip of conductive material to include a plurality of cutouts or voids 64 and at least one slot 66 arranged and configured to define the high resistance bridge described above. The fuse assembly 10 further includes the overload element 16 electrically coupled to the short circuit element 14. In particular, the overload element 16 of the present example includes a pair of solder bars 68 electrically coupled to the short circuit element 14 and the first conductive cap 60.

The fuse indicator assembly 12 includes one of the short circuit indicators 18 discussed above and is enclosed within a see-through cover 70. The overload current indicator 20 is likewise enclosed within a cover 72. The fuse indicator assembly 12 is arranged in parallel to the fuse element assembly 10. First and second offset resistors 22, 24 isolate the fuse indicator assembly 12 and present a significantly higher impedance than that of fuse elements of the fuse element assembly 10. The fuse indicator assembly 12 is further connected to the fuse element assembly 10 via a shunt 25 secured to the short circuit element 14 and indicator conductor 29. In this way, an alternative electrical path exists between the first conductive cap 60 and the second conductive cap 62 depending on the failure mode experienced by the electrical fuse 2.

It will be understood that the housing 58 can be a cylindrical housing, an insulating substrate, etc. Housing 58 may be filled with, e.g., sand to absorb the energy of an element opening fault. The teaching of FIG. 3 are equally applicable to assembly 112, with regards the need for resistors 22 and 24.

Figure 4:
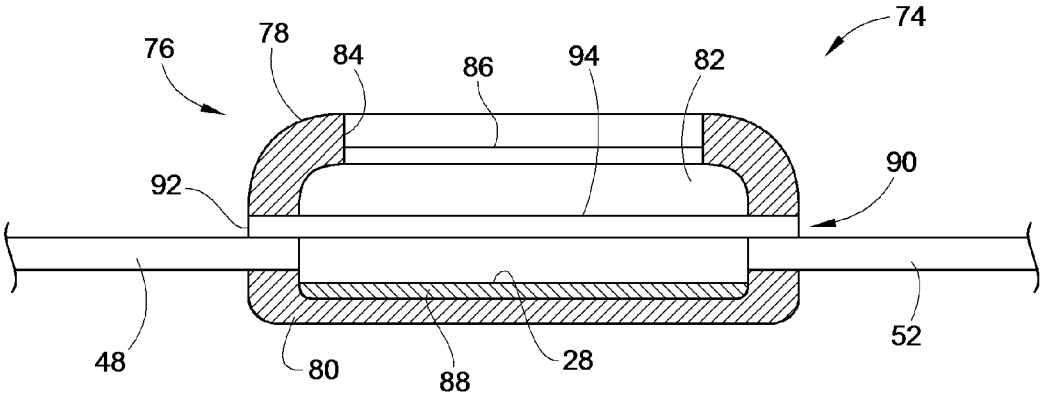
FIGS. 4 and 5 are side elevation views of other embodiments of fuse indicator devices constructed in accordance with the teachings of the disclosure provided herein.
Figure 5:
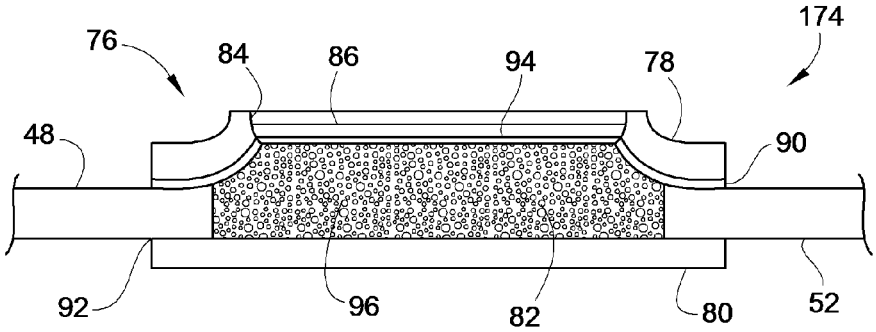

FIGS. 4 and 5 are side elevation views of other embodiments of fuse indicator devices constructed in accordance with the teachings of the disclosure provided herein. Generally, these alternate fuse indicator devices include a thin film of indicator material such as, for example, silver (Ag) high carbon content silver (Ag) or a reactive material such as alternating nano-layers of nickel and aluminum deposited 100 nm thick. The indicator material is typically carried or supported within a two-part or clamshell housing configured to couple the indicator material electrically to a pair of electrical conductors.

FIG. 4 illustrates one alternate embodiment of a fuse indicator device 74 that can be used as either or both a the short-circuit indicator or an overload indicator. The fuse indicator 74 includes a housing 76 having a top portion 78 and a base portion 80 cooperating to define an interior 82. The top portion 78 includes an opening 84 arranged to carry a clear or translucent window 86. The base portion 80 may include the visually perceptible indicator portion 28 deposited on a surface 88 of the interior 82. The housing 76 further includes a pair of apertures 90, 92 arranged to support and carry the electrical conductors 48, 52.

The fuse indicator 74 and the housing 76 supports indicator material 94. The indicator material 94 is electrically coupled to the electrical conductor 48 and 52. The indicator material 94 is a shiny or reflective material in one embodiment, which is positioned between the window 86 and the visually perceptible indicator portion 28 physically blocking the view of visually perceptible indicator portion 28, which can be a markedly different color or pattern from material 94. The indicator material 94 in one embodiment is a thin-film material approximately 1000 angstroms (Å) thick. The thickness of the indicator material 94 is determined by the opacity of the material in conjunction with its ability to vaporize or react in response to an increase in electrical energy cause by an overload or a short circuit.

During normal operation, e.g., when no short circuit or overload conditions exist, the reflective indicator material 94 is clearly visible through the window 86. The occurrence of a failure mode or fault state causes increased electrical flow through the electrical conductors 48, 52 (as discussed above) which, in turn, causes a reaction in the indicator material 94. The reaction may be a self-propagating reaction through the reactive nano-type material discussed above or may cause the ignition and/or disintegration of the thin-film layer of silver or high carbon silver. Regardless of the reaction, the removal of the indicator material 94 exposes the visually perceptible indicator portion 28 to the window 86. In this way, a user can look through the window 86 and determine the state of the electrical fuse 2 by determining whether the fuse indicator 74 appears shiny, i.e., the indicator material 94 is intact, or colored, i.e., the indicator material 94 is removed.

FIG. 5 illustrates another alternative embodiment of a fuse indicator device 174 that can be used as either or both the short-circuit indicator or the overload indicator. Like the disclosure above in connection with FIG. 4, the fuse indicator 174 includes a housing 76 having a top portion 78 and a base portion 80 cooperating to define an interior 82. The top portion 78 includes an opening 84 arranged to carry a clear or translucent window 86. A layer of indicator material 94 is deposited along the base of the top portion 78 and the translucent window 86 in electrical communication with the electrical conductors 48, 52 which are positioned within the apertures 90, 92.

The interior 82 of the housing 76 can be packed or filled with colored sand or particulate 96 that supports or protects the window 86 and indicator material 94 from damage caused by shocks and sudden jarring. Particulate 96 also serves as a porous medium for material 94 to diffuse into when it reacts to the short circuit or overload condition. Upon removal of the reactive or indicator material 94 via any of the mechanisms described above, the colored particulate 96 becomes visible through the window 86 to indicate the fault state and possibly the failure mode of the fuse indicator 174 and the overall electrical fuse 2.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A diagnostic fuse indication device, the device comprising:

a short circuit element;

a short circuit indicator electrically coupled to the short circuit element in a parallel arrangement, wherein the parallel arrangement comprises a shunt;

an overload current element electrically coupled to the short circuit element in a series arrangement, and electrically coupled to the short circuit indicator in a series arrangement;

an overload current indicator electrically coupled to the overload current element in a parallel arrangement, wherein the parallel arrangement comprises a shunt, the overload current indicator also electrically coupled to the short circuit element in a series arrangement;

a first indicator material deposited adjacent to the short circuit indicator; and a second indicator material deposited adjacent to the overload current indicator, wherein the first indicator material reacts in response to a short circuit event to reveal the short circuit indicator, and wherein the second indicator material reacts in response to an overload current event to reveal the overload current indicator, wherein the first and second indicator materials each comprise at least one spark gap.

2. The fuse indication device of claim 1, wherein the short circuit element is a conductive metal comprising a plurality of bridges.

3. The fuse indication device of claim 1, wherein the overload current element is manufactured from the material selected from the group consisting of copper-nickel alloy, silver plated brass, tin lead solder, lead free solder, copper, gold, silver, zinc or their alloys having a suitably low melting temperature.

4. The fuse indication device of claim 1, wherein the first and second indicator materials are reactive materials.

5. The fuse indication device of claim 4, wherein the reactive materials are nano-layered films.

6. The fuse indication device of claim 4, wherein the reactive material is configured to produce a self-propagating exothermic reaction in response to an energy input.

7. The fuse indication device of claim 6, wherein the energy input is selected from the group consisting of:

a current overload, a short circuit, a heated filament, a flame, focused radio frequency radiation, or light amplification by stimulated emission of radiation.

8. The fuse indication device of claim 4, wherein the reactive material is deposited to form at least one high resistance bridge.

9. The fuse indication device of claim 8, further comprising a first offset resistor electrically coupled to the short circuit indicator in a series arrangement, and a second offset resistor electrically coupled to the overload current indicator in a series arrangement.

10. The fuse indication device of claim 4, wherein the at least one spark gap comprises a gap of about 0.002 inches (about 50 micrometers).

11. The fuse indication device of claim 1, further comprising at least one housing that supports the short circuit element and the short circuit indicator.

12. A diagnostic fuse indication device, the device comprising:

a short circuit element;

a short circuit indicator electrically coupled in a parallel arrangement to the short circuit element, wherein the parallel arrangement comprises a shunt;

an overload current element electrically coupled to the short circuit element in a series arrangement;

an overload current indicator electrically coupled to the overload current element in a parallel arrangement, wherein the parallel arrangement comprises a shunt;

a first reactive material deposited adjacent to the short circuit indicator; and a second reactive material deposited adjacent to the overload current indicator, wherein the first and second reactive materials each comprise at least one spark gap, and wherein the first reactive material reacts in response to a short circuit event to reveal the short circuit indicator, and wherein the second reactive material reacts in response to an overload current event to reveal the overload current indicator.

13. The fuse indication device of claim 12, wherein the reactive material is configured to produce a self-propagating exothermic reaction.

14. The fuse indication device of claim 12, wherein the reactive material is a nano-layered film.

15. The fuse indication device of claim 12, wherein the reactive material is an indicator material consisting of high-carbon content silver.

16. A diagnostic fuse indication device, the device comprising:

an insulating substrate;

a short circuit indicator assembly carried by the insulating substrate, the short circuit indicator including:

a short circuit element;

a short circuit indicator electrically coupled in a parallel arrangement to the short circuit element, the parallel arrangement comprising a shunt;

a reactive material deposited adjacent to the short circuit indicator, wherein the reactive material reacts in response to a short circuit event to reveal the short circuit indicator; and a current overload assembly carried by the insulating substrate and electrically coupled to the short circuit assembly, the current overload assembly including:

an overload current element;

an overload current indicator electrically coupled in a parallel arrangement to the overload current element, wherein the parallel arrangement comprises a shunt;

a reactive material deposited adjacent to the overload current indicator, wherein the reactive material reacts in response to an overload current event to reveal the overload current indicator, wherein the reactive material deposited adjacent to the short circuit indicator and the reactive material deposited adjacent to the overload current indicator each comprise at least one spark gap separating portions of the reactive material.

17. The fuse indication device of claim 16, wherein insulating substrate is manufactured from the material selected from the group consisting of: flame retardant woven glass reinforced epoxy laminates, non-woven glass laminates, ceramics, PTFE, microfiber glass substrates, thermoset plastics, polyimide materials, or any combination of these materials.

18. The fuse indication device of claim 16, wherein the reactive material is configured to produce a self-propagating exothermic reaction.

19. The fuse indication device of claim 16, wherein the reactive material is a nano-layered film.

20. The fuse indication device of claim 16, wherein the reactive material is an indicator material consisting of high-carbon content silver.

* * * * *